US007401991B2

(12) United States Patent
Goeree et al.

(10) Patent No.: US 7,401,991 B2
(45) Date of Patent: Jul. 22, 2008

(54) FRAME STRUCTURE FOR A SCANNING-TYPE PRINTER

(75) Inventors: Barry B. Goeree, Venlo (NL); Henk-Jan Zwiers, Venlo (NL); Frank J. H. Nottelman, Belfeld (NL); Luc G. T. Dircks, Leunen (NL)

(73) Assignee: Oce-Technologies B.V., Venlo (NL)

( * ) Notice: Subject to any disclaimer, the term of this patent is extended or adjusted under 35 U.S.C. 154(b) by 393 days.

(21) Appl. No.: 11/312,500

(22) Filed: Dec. 21, 2005

(65) Prior Publication Data

US 2006/0133883 A1 Jun. 22, 2006

(30) Foreign Application Priority Data

Dec. 22, 2004 (EP) ..... 04106834

(51) Int. Cl.
*B41J 3/39* (2006.01)
*B41J 29/02* (2006.01)
*B41J 29/12* (2006.01)

(52) U.S. Cl. ..... 400/691; 400/323; 400/691

(58) Field of Classification Search ..... 400/323, 400/624, 691, 692
See application file for complete search history.

(56) References Cited

U.S. PATENT DOCUMENTS 4,502,796 A 3/1985 Wilczewski et al.
4,802,795 A * 2/1989 Takada ..... 400/600
5,032,034 A * 7/1991 Bischof et al. ..... 400/660
5,393,152 A 2/1995 Hattori et al.
6,634,819 B2 * 10/2003 Uchida ..... 400/691
6,899,751 B2 * 5/2005 Arita et al. ..... 106/31.27
2004/0183850 A1 9/2004 Takeuchi et al.

* cited by examiner

*Primary Examiner*—Daniel J. Colilla
*Assistant Examiner*—M. Ferguson-Samreth
(74) *Attorney, Agent, or Firm*—Birch, Stewart, Kolasch & Birch, LLP

(57) ABSTRACT

A printer including a frame, a feed roller rotatably supported in the frame for advancing a recording medium, a sheet support plate for supporting said recording medium, a guide rail extending in parallel with an axial direction (Y) of the feed roller, and a carriage guided at the guide rail and carrying a printhead facing the recording medium on the sheet support plate, the frame being composed of a support structure and two plate-like function blocks, which are supported on said support structure at both ends of the feed roller so as to extend in respective planes (X-Z) normal to said axial direction (Y), and which support the guide rail and the sheet support plate, wherein the feed roller is rotatably supported in two bearings, each of which has a bearing case, each bearing case being supported on a member of the support structure, each of the function blocks defining a downwardly open V-shaped notch which is supported on the peripheral surface of one of the bearing cases at exactly two points, and the guide rail rests on V-shaped top surfaces of the function blocks and is thereby accurately positioned in both directions (X, Z) normal to said axial direction (Y).

8 Claims, 2 Drawing Sheets

FRAME STRUCTURE FOR A SCANNING-TYPE PRINTER

This non-provisional application claims priority under 35 U.S.C. § 119(a) on Patent Application No. 04106834.7 filed in Europe on Dec. 22, 2004, which is herein incorporated by reference.

BACKGROUND OF THE INVENTION

The present invention relates to a printer containing a frame, a feed roller rotatably supported in the frame for advancing a recording medium, a sheet support plate for supporting the recording medium, a guide rail extending substantially parallel with an axial direction of the feed roller, and a carriage guided at the guide rail and carrying a printhead facing the recording medium on the sheet support plate. The frame is composed of a support structure and two plate-like function blocks which are supported on the support structure at both ends of the feed roller so as to extend in respective planes normal to said axial direction, and which support the guide rail and the sheet support plate.

A related printer is disclosed in U.S. Pat. No. 4,502,796.

A typical example of a printer of this type is an ink jet printer having a printhead or printheads adapted to expel droplets of liquid ink onto the recording medium when the carriage moves along the guide rail to scan the recording medium in a main scanning direction while the recording medium is advanced over the sheet support plate in a sub-scanning direction. The timings at which the nozzles of the printhead are energised must be accurately synchronised with the movement of the carriage relative to the recording medium. To this end, the carriage may be equipped with a detector for reading markings on a ruler. However, in order to achieve a high print quality, it is essential that the feed roller and the sheet support plate, which determine the position of the recording medium, and the guide rail for the carriage are stably and accurately positioned relative to one another. For this reason, conventional printers have a relatively expensive frame structure which is manufactured with high accuracy and provides a sufficient stiffness, especially in view of reaction forces that are caused by the reciprocating scanning movement of the carriage.

SUMMARY OF THE INVENTION

An object of the present invention is to provide a printer which has a simple construction and nevertheless permits a high print quality. According to the present invention, this object is achieved by a printer of the type indicated above, wherein the feed roller is rotatably supported in two bearings, each of which has a bearing case, each bearing case being supported on a member of the support structure. Each of the function blocks defines a downwardly open V-shaped notch which is supported on the peripheral surface of one of the bearing cases at exactly two points, and the guide rail rests on V-shaped top surfaces of the function blocks and is thereby accurately positioned in both directions normal to said axial direction.

Since the guide rail and the sheet support plate are both located in the vicinity of the feed roller, the two plate-like function blocks, which function as an acuate support for both the guide rail and the sheet support plate, may have relatively small dimensions and, as a consequence, may be machined very acuately at relatively low costs. Moreover, these function blocks may provide a very high stiffness, especially in the two directions (X and Z) normal to the main scanning direction (Y) which is the axial direction of the feed roller. Since the two function blocks alone assure that the feed roller, the guide rail and the sheet support plate are precisely positioned relative to one another, the stiffness and accuacy requirements for the rest of the frame structure, i. e. the support structure, may be less critical. On the contrary, it may even be an advantage if the support structure has a certain compliance in comparison to the rigid unit formed by the function blocks, the feed roller, the guide rail and the sheet support plate. As a result, the costs for the frame structure as a whole may be reduced significantly, and nevertheless, a high a accuracy is stably assured in those parts where accuracy is important.

In order to avoid over-constraints, it is preferable that each bearing case is supported on the support structure at only two points. The guide rail may be rigidly connected to the two function blocks in the main scanning direction Y, so that the guide rail and the function blocks form a rigid unit.

However, as an alternative, it is possible that the guide rail is slidingly or compliantly supported on the function blocks in the Y-direction, provided that the guide rail is rigidly supported in the Y-direction directly on the support structure of the frame. In the latter case, however, the Y-position of the carriage along the guide rail should be measured directly in relation to the position of the feed roller or the recording medium rather than to the position of the guide rail.

Preferably, the two function blocks, together, support the sheet support plate at only three points, i. e., without over-constrains. Moreover, the sheet support plate should be rigidly connected to only one of the function blocks, while it is allowed to slide in Y-direction relative to the other function block. This is particularly advantageous when the sheet support plate is subject to thermal expansion and contraction, as is the case, for example, in a hot melt ink jet printer. In such a printer, the ink that is used in the printheads is solid at room temperature and must be heated to 100° C. or more, for example, in order to become liquid. Then, the sheet support plate is preferably heatable and temperature-controlled so as to control the cooling and solidification rate of the ink that has been deposited on the recording medium.

BRIEF DESCRIPTION OF THE DRAWINGS

Embodiments of the present invention will now be described in conjunction with the drawings, in which.

DETAILED DESCRIPTION OF THE INVENTION

Figure 1:
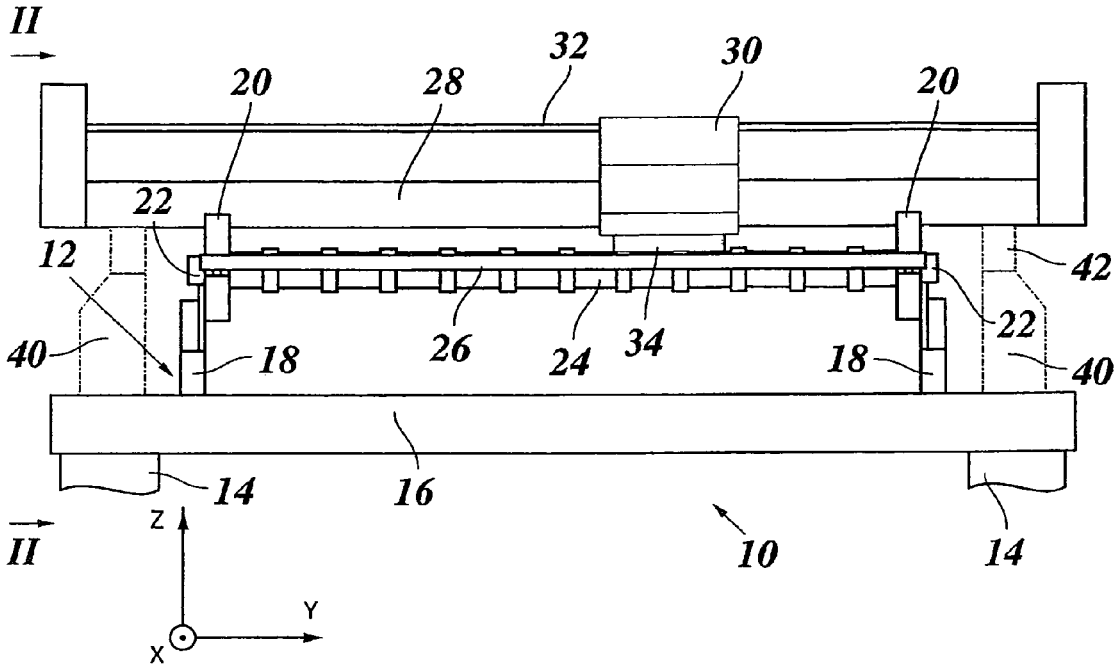
FIG. 1 is a front view of a printer according to the present invention.

The printer shown in FIG. 1 includes a frame 10 having a lower support structure 12 formed by two uprights 14, two cross-bars 16, and two mounting plates 18 rising up from the cross-bars 16. A plate-like function block 20 is attached to each of the mounting plates 18 and extends in parallel therewith. Two bearings 22 rotatably support a feed roller 24 between the two mounting plates 18.

A sheet support plate 26 is horizontally supported on the two function blocks 20 and serves to support a sheet of a recording medium (not shown) which is advanced in X-direction (normal to the plane of the drawing in FIG. 1) by means of the feed roller 24. A drive mechanism for the feed roller 24 has not been shown here for simplicity.

A guide rail 28 rests on the top ends of the function blocks 20 and extends in parallel with the axial direction Y of the feed roller 24. A carriage 30 is guided on the guide rail 28 and is driven to move back and forth along the guide rail by means of a belt-type drive mechanism 32, for example. The carriage 30 has a portion extending over the sheet support plate 26, and a printhead 34 is mounted on the bottom side of this carriage portion so as to face the sheet that is advanced over the sheet support plate 26. The printhead 34 may for example be a hot melt ink jet printhead.

A detection and control system, which may have a conventional design and has not been shown here, detects the Y-position of the carriage 30 and determines the timings at which the print units or nozzles of the printhead 34 are energised while the carriage moves across the recording medium.

Figure 2:
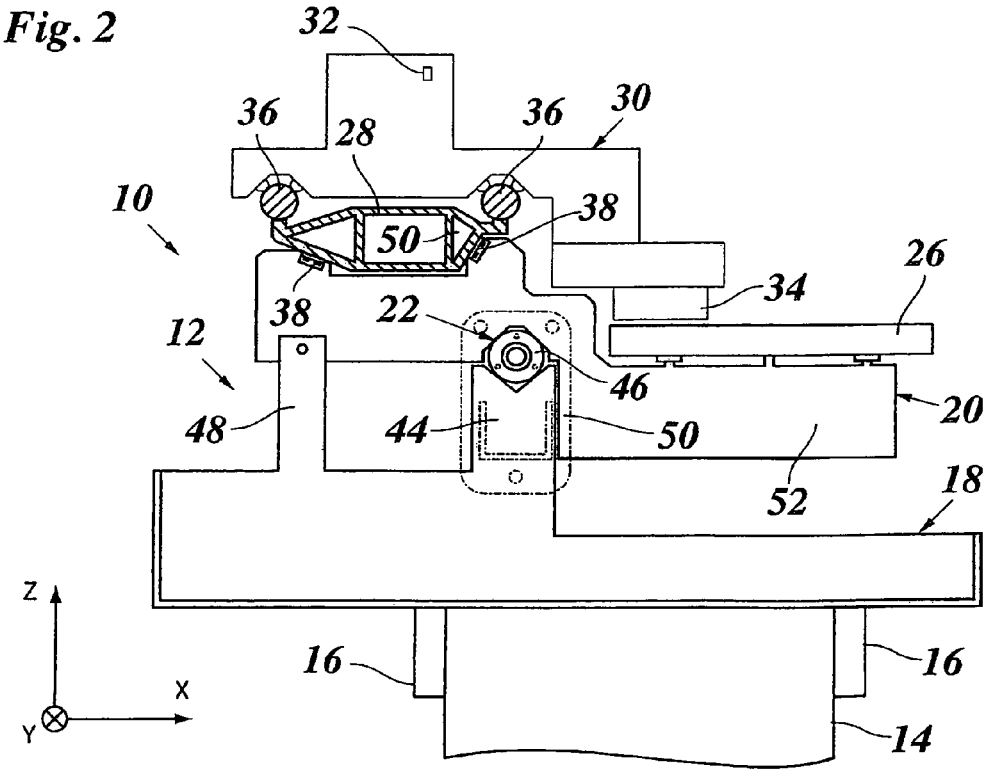
FIG. 2 is an elevational view of the printer in the direction of the arrows II-II in FIG. 1, and FIGS. 3 and 4 are enlarged end views of opposite ends of a sheet support plate.

As is shown in FIG. 2, the guide rail 28 is formed by a profile member which supports two cylindrical rods 36 on which the carriage 30 is supported and guided with roller bearings. The guide rail 28 rests on V-shaped top surfaces of the function blocks 20 and is thereby accurately positioned in X-direction, i.e., the direction, in which the recording medium advances, and in Z-direction. In the example shown the guide rail 28 is rigidly connected to each of the function blocks 20 also in the Y-direction, by means two brackets 38.

Optionally, the guide rail 28 may be rigidly supported in the Y-direction by mechanical links 40 which connect the guide rail directly to the cross-bars 16, as has been shown in phantom lines in FIG. 1. The mechanical links 40 may each comprise a leaf spring 42 which is flexible in X-direction but stiff in Y-direction.

As is shown in FIG. 2, the mounting plate 18 has an upwardly extending projection 44 defining an upwardly open V-shaped notch which supports, at exactly two points, the cylindrical peripheral surface of a bearing case 46 of the bearing 22 for the feed roller 24. Similarly, the function block 20 has a downwardly open V-shaped notch which rests upon the peripheral surface of the bearing case 46, again exactly at two points. In this way, the function blocks 20 are precisely positioned relative the central axis of the feed roller 24. The guide rail 28 and the sheet support plate 26 are supported on the function block 20 on opposite sides of the axis of the feed roller, so that the structure, as a whole, is essentially weight-balanced. In addition, a strip 48 of relatively thin sheet metal projects from the mounting plate 18 and is fixed to one end of the function block 20 so as to define the angular position of the function block about the axis of the feed roller and the bearing case 46.

As shown in phantom lines in FIG. 2, a bracket 50, which is to accommodate a drive mechanism (not shown) for the feed roller 24, is attached to the bearing case 46 and/or to portions of the function block 20 and the mounting plate 18 in the vicinity thereof and stabilizes the position of the function block 20 in the Y-direction.

Figure 3:
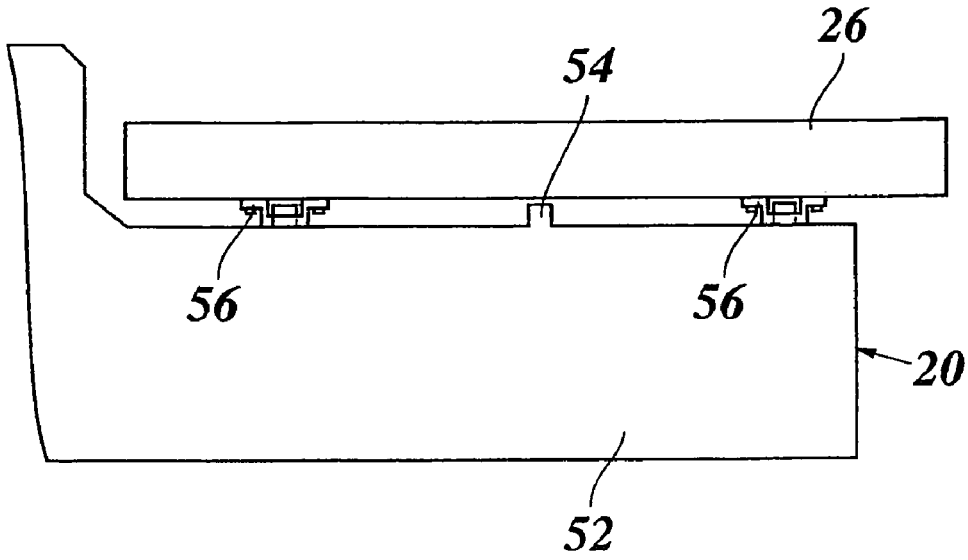
Figure 4:
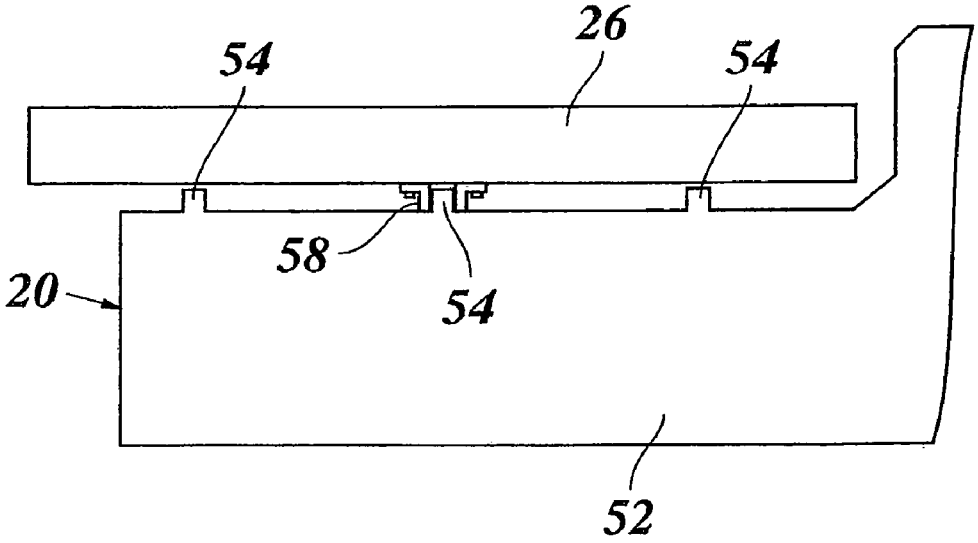

The sheet support plate 26 is supported on horizontally projecting arms 52 of the two function blocks 20 at three points, in total. More precisely, as has been shown in FIGS. 3 and 4, the arm 52 of each function block 20 has three upwardly projecting lugs 54, and one end of the sheet support plate 26 (FIG. 3) is fixedly attached on two of these lugs by means of brackets 56, whereas the other end (FIG. 4) is slidingly guided in the Y-direction on the third (central) lug 54 by means of a guide 58. Thus, the sheet support plate 26 is stably supported on the function blocks 20 but is free to expand and contract in its lengthwise direction, when it is subject to temperature changes. In a hot melt ink jet printer, the sheet support plate 26 is preferably heated and kept at a temperature that is appropriately adapted to the temperature of the ink, while the printer is operating. The expansions and contractions caused by heating and cooling the sheet support plate 26 will not distort the function blocks 20.

In a scanning-type ink jet printer, the distance between the printhead 34 and the surface of the sheet support plate 26, i. e. the flight distance of the ink droplet, is critical for the quality of the printed image and should therefore be stable and uniform. It would be possible to make the sheet support plate 26 height-adjustable so as to adjust the flight distance of the ink droplets. However, in the present invention, the function blocks 20 are precisely machined and provide a good reference for the height of the sheet support plate 26, and it is therefore preferred that the brackets 56 and the guide 58 are adapted to define a fixed distance between the function blocks 20 and the sheet support plate 26.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. A printer comprising:

a frame, a feed roller rotatably supported in the frame for advancing a recording medium, a sheet support plate for supporting the recording medium, a guide rail extending in substantial parallel relationship with the axial direction (Y) of the feed roller, and a carriage guided at the guide rail and carrying a printhead facing the recording medium disposed on the sheet support plate, the frame including a support structure and two plate-like function blocks which are supported on said support structure at both ends of the feed roller so as to extend in respective planes (X-Z) normal to the axial direction (Y) of the feed roller, and which support the guide rail and the sheet support plate, wherein the feed roller is rotatably supported in two bearings, each of which has a bearing case, each bearing case being supported by a member of the support structure, each of the function blocks defining a downwardly open V-shaped notch which is supported on the peripheral surface of one of the bearing cases at exactly two points, and the guide rail rests on V-shaped top surfaces of the function blocks and is thereby accurately positioned in both directions (X, Z) normal to said axial direction (Y).

2. The printer according to claim 1, wherein the member of the support structure defines an upwardly open V-shaped notch which supports the peripheral surface of the bearing case at exactly two points.

3. The printer according to claim 2, wherein the member of the support structure has a projecting strip that is directly connected to the function block at a position offset from the bearing.

4. The printer according to claim 1, wherein the guide rail and the sheet support plate are supported on the function blocks on opposite sides of the feed roller.

5. The printer according to claim 1, wherein the member of the support structure is a mounting plate made of sheet metal and extending in parallel with the function block.

6. The printer according to claim 1, wherein the guide rail is rigidly connected to the function blocks.

7. The printer according to claim 1, wherein the sheet support plate is supported on the two function blocks at exactly three points, in total.

8. The printer according to claim 1, wherein the sheet support plate is fixed on one of the function blocks in the axial direction and is free to move relative to the other of the function blocks in that direction.

* * * * *